United States Patent [19]

Garfinkle

[11] 4,149,333

[45] Apr. 17, 1979

[54] ASSEMBLABLE DISPLAY DEVICE FOR MAILBOXES AND THE LIKE

[75] Inventor: Sandor A. Garfinkle, Wayne, N.J.

[73] Assignee: Gemini Industries, Inc., Clifton, N.J.

[21] Appl. No.: 757,512

[22] Filed: Jan. 7, 1977

[51] Int. Cl.[2] ..... G09F 23/00

[52] U.S. Cl. ..... 40/606

[58] Field of Search ..... 40/125 H, 140, 142 R, 40/19, 10 C, 10 D, 16, 606

[56] References Cited

U.S. PATENT DOCUMENTS

| | | | |
|---|---|---|---|
| 173,286 | 2/1876 | Hepineuze | 40/10 C |
| 1,636,500 | 7/1927 | Cox | 40/10 C |
| 1,854,908 | 4/1932 | Northup | 40/10 C |
| 2,509,930 | 5/1950 | Kohl | 40/125 H |
| 2,540,221 | 2/1951 | Ten Hoeve et al. | 40/10 D |
| 2,599,921 | 6/1952 | Johnson | 40/140 |

FOREIGN PATENT DOCUMENTS

| | | | |
|---|---|---|---|
| 10321 of | 1900 | United Kingdom | 40/10 C |

*Primary Examiner*—Louis G. Mancene
*Assistant Examiner*—Wenceslao J. Contreras
*Attorney, Agent, or Firm*—Morgan, Finnegan, Pine, Foley & Lee

[57] ABSTRACT

An assemblable display device includes an elongate base plate supporting characters of the message to be displayed, an open-ended, generally tubular, transparent sleeve member about equal in length to the base plate and adapted to encase the base plate, and a pair of mounting members adapted to enclose each end of the sleeve in a generally sealing manner and to provide mounting surfaces for attaching the device to a suitable mounting structure. Advantageously, the device further includes adaptor plates adapted for removable attachment to the mounting brackets for providing interchangeable mounting surfaces onto the mounting brackets.

14 Claims, 3 Drawing Figures

ASSEMBLABLE DISPLAY DEVICE FOR MAILBOXES AND THE LIKE

BACKGROUND AND OBJECTS OF INVENTION

The present invention relates generally to display devices and more particularly to display devices for outdoor use on mailboxes and the like.

A wide variety of display devices are in common use for various applications. Many such devices adapted for outdoor use, particularly for rural mailboxes, are made of a metallic backing, or frame, to which a name, etc. is mounted, and which is permanently attached to the mailbox by welding or by threaded fasteners. Although such devices adequately serve as nameplates, they are relatively expensive since they must be fabricated by machinists equipped to do so, and are incapable of complete assembly and simple installation by hand at home. In addition, such prior art devices are usually adapted for permanent attachment to the mailbox and cannot be removed without damaging in the mailbox and/or the device itself. Moreover, since the message on the nameplate is directly exposed to all weather conditions, the letters themselves must be capable of withstanding such weather conditions and are, therefore, relatively expensive to fabricate.

One type of mailbox display device is illustrated in U.S. Pat. No. 2,976,633, issued to Squire. Although such devices have proved satisfactory, the letters or characters installed on the device are exposed to the weather elements and, therefore, must be durable, thereby involving relatively high fabrication and materials costs. Such letters are also generally three-dimensional, adding to the aforesaid costs, and must be purchased separately, causing frustration when a particular letter or number is out-of-stock. In addition, these devices are mounted to the mailbox by threaded fasteners, adding to the cost of the device and complicating installation.

In addition, although there are display devices, such as disclosed in U.S. Pat. Nos. 3,956,837 or 3,820,262, which are easily assemblable, they do not provide protection against adverse weather elements. Thus, they are unsuitable for outdoor use.

Accordingly, it is an object of the present invention to provide a new and improved display device for mailboxes and the like. Another object of the invention is to provide a new and improved display device which can be packaged in a completely self-contained and disassembled form for assembly in only a few simple steps without tools.

It is also an object of the present invention to provide a new and improved assemblable display device capable of use outdoors, which is particularly suited as a nameplate for mailboxes.

It is an additional object of the present invention to provide a new and improved asemblable display device adaptable for quick and simple attachment to mounting surfaces of various general contours.

It is still another object of the present invention to provide a new and improved display device for mailboxes and the like, which is inexpensive and can be made essentially from all moldable parts.

It is a further object of the present invention to provide a new and improved assemblable display device for mailboxes and the like, which, when installed outdoors, is substantially unaffected by adverse weather conditions.

It is yet another object of the present invention to provide a new and improved assemblable display device for mailboxes and the like, which provides display surfaces observable from opposite sides.

Objects and advantages of the invention are set forth in part herein and in part will be appreciated herefrom, or may be learned by practice with the invention, the same being realized and attained by means of the instrumentalities and combinations pointed out in the appended claims. Accordingly, the invention resides in the novel parts, arrangements, combinations and improvements herein shown and described.

SUMMARY OF INVENTION

Briefly described, the display device according to the present invention includes a generally elongate base plate adapted to support the characters of the message to be displayed, an essentially transparent sleeve member adapted to enclose the front and back surfaces (i.e., the display surfaces) and side edges of the base plate and a pair of mounting members adapted for attachment to each end of the sleeve in a generally sealing manner. Advantageously, each mounting member includes an end cap adapted to be fitted over one end of the sleeve and a mounting bracket adapted to be force fit over the end cap on the end of the sleeve, and adapted to be attached to any suitable mounting structure. Advantageously, and as preferably embodied, the display device according to the invention includes a pair of adaptor plates adapted for releasable attachment to the mounting brackets and having a surface adapted for direct attachment to the mounting structure.

It has been found that the display device according to the present invention provides an easily assemblable and inexpensive structure for displaying a desired message such as a name and address. In addition, by providing a transparent sleeve enclosing the base plate with mounting members sealingly enclosing the ends of the sleeve according to the present invention, the display device according to the invention provides a durable and essentially weatherproof means for displaying the message on two surfaces, for outdoor as well as indoor use. Moreover, the display device according to the present invention will be found particularly suited for providing a mailbox nameplate which complies with all requirements set by the U.S. Postal Service for rural mailboxes, including, for example, being viewable from both sides of the mailbox.

In addition, the display device according to the present invention enables the use of moldable plastic materials as well as the utilization of convenient molding techniques associated therewith. Thus, for example, the base plate may be formed as a generally flat member which may be folded over itself into its final shape while warm and pliable and the sleeve member may be molded as a simple open-ended tube-like member.

It will also be found that by providing adaptor plates which are releasably attachable to (i.e. interchangeable with) the mounting brackets, the actual mounting surface of the brackets can be changed to accommodate mounting structures of different contours or configurations, such as, for example, a flat or round top mailbox. In addition, by providing adhesive means for attaching the display device to the mounting structure, the display device according to the invention can be quickly and simply attached to the mounting structure without damaging it.

Moreover, it will be found that the display device according to the invention enables the use of simple and inexpensive adhesive-backed characters which can be die cut on a carrier sheet. Thus, the display device can be packaged as a complete and inexpensive kit including a plurality of each letter and number for convenient assembly. Furthermore, by providing mounting members which are force fit over the open ends of the sleeve member, the contents within the sleeve member are easily and inexpensively sealed in an essentially weatherproof manner.

DETAILED DESCRIPTION OF PREFERRED EMBODIMENTS

Figure 1:
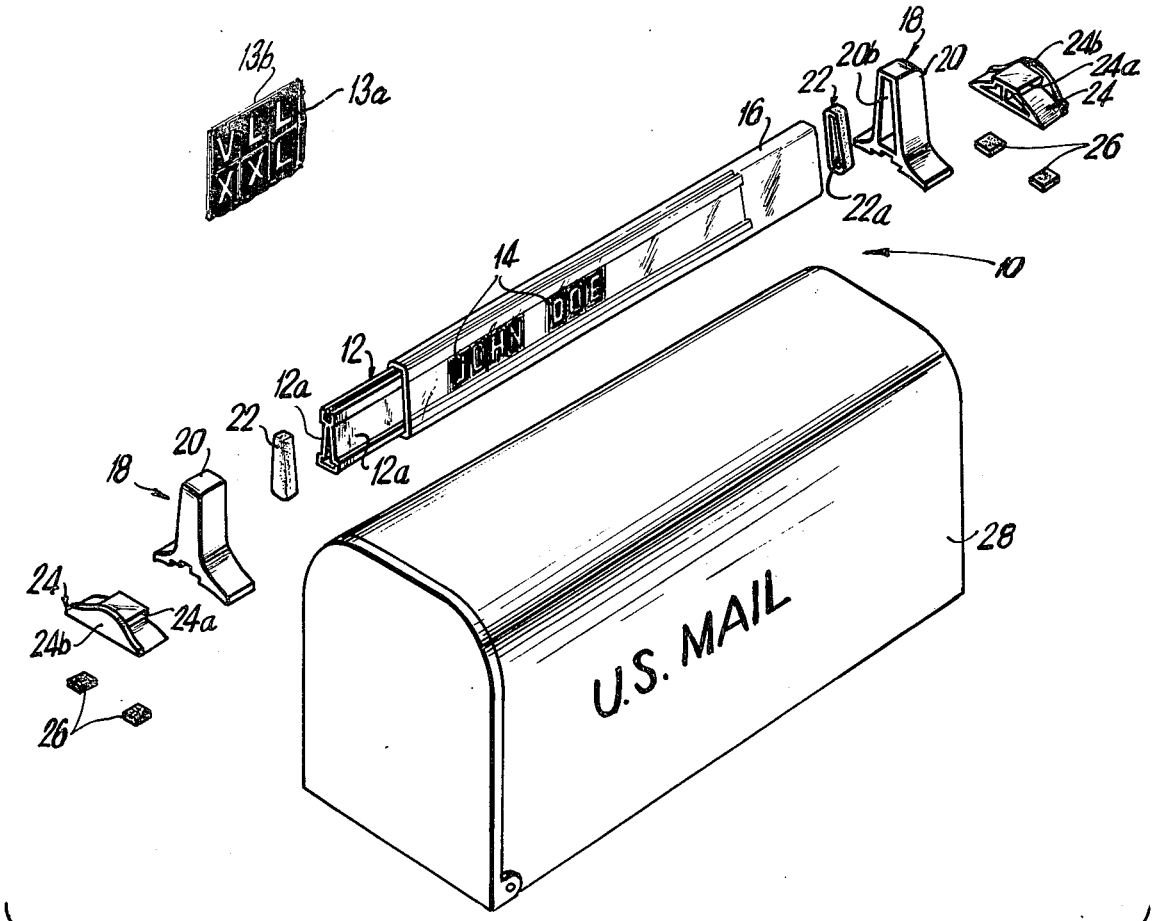
FIG. 1 is an exploded perspective view of a preferred embodiment of an assemblable display device according to the present invention.
Figure 2:
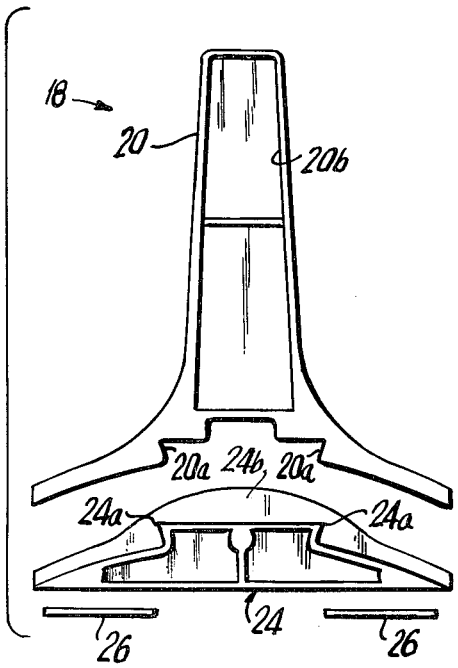
FIG. 2 is an end view of a preferred embodiment of a mounting bracket according to the present invention.

Referring now to the embodiments of the invention shown in the accompanying drawings, there is shown in FIG. 1, an exploded perspective view of a preferred embodiment (indicated generally by reference number 10) of the assemblable display device according to the present invention.

In accordance with the invention, display device 10 includes base plate 12 which is adapted for supporting or carrying the various characters of the message or information to be displayed. To this end, base plate 12 is advantageously formed with recessed display surface 12*a* adapted to accommodate message characters (indicated generally at 14) of various sizes and thicknesses, up to about the dimensions of the recess. As preferably embodied, characters 14 are generally thin flexible plastic members having an adhesive backing and may be die cut from sheet 13*a* adhered to a generally non-stick backing sheet 13*b* in order to provide, relatively inexpensively, a complete set of message characters, including several of each character.

Sleeve member 16, formed of an essentially transparent material, is proportioned to encase base plate 12 with message characters 14 thereon. As preferably embodied, sleeve member 16 is an essentially continuous, elongate tube-like element having both of its ends open to accommodate slidable insertion of base plate 12. Advantageously, for low cost of fabrication, sleeve 16 is made of a clear moldable plastic material and base plate 12 is made of an opaque moldable plastic material.

Once base plate 12 carrying message characters 14 has been inserted within sleeve 16, mounting members (indicated generally at 18) are attached to the ends of sleeve 16 for completely enclosing base plate 12 as well as mounting display device 10 to a suitable mounting structure. Advantageously, each mounting member 18 includes mounting bracket 20 (also advantageously made of a moldable plastic material) adapted to cover each end of sleeve 16 for protection against the weather elements. To this end, mounting member 18 also includes end caps 22 preferably made of a flexible resilient material such as plastisol (or other similar soft vinyl-like material capable of retaining its physical properties despite long term exposure to various weather conditions), formed in a generally elongate cup-shaped structure adapted to fit onto an end of sleeve 16 in a somewhat tight manner. Advantageously, as shown more clearly in FIG. 3, the perimeter along the interior surface of the recess (indicated at 22*a*) formed in end cap 22 is slightly less than the cross-sectional perimeter along the exterior surface of sleeve 16 such that each end cap 22 must be slightly stretched to cover the end of sleeve 16 in a generally tight manner. Therefore, end caps 22 form a generally seal-like cover over the ends of sleeve 16.

Once end caps 22 are positioned over the ends of sleeve 16, mounting brackets 20 are fitted over caps 22 to complete the seal on the sleeve ends. To this end, each mounting bracket 20 includes recess 20*b* proportioned essentially similar to the cross-sectional area of sleeve 16 and adapted to receive one end of sleeve 16 with an end cap 22 mounted on such end. As preferably embodied, the interior of recess 20*b* is dimensioned such that the perimeter along its interior surface is larger than the perimeter along the exterior surface at the ends of sleeve 16, but less than that along the exterior surface of an end cap 22 when mounted onto an end of sleeve 16. Thus, when mounting brackets 20 are mounted onto the ends of sleeve 16, over end caps 22, a force-fit is generated which ensures an essentially mositure-proof seal to enable use of display device 10 outdoors.

Figure 3:
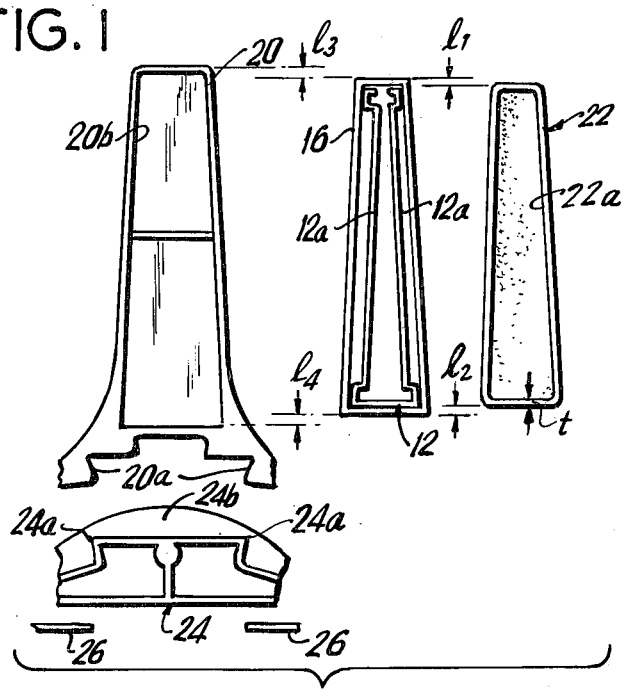
FIG. 3 is an end view of a preferred embodiment, in disassembled form, of the embodiment of FIG. 1.

For example, the length of each end cap 22, measured at its exterior surface, may be slightly less than the cross-sectional length of sleeve 16, measured at its exterior surface, by a distance $l_2+l_2$ shown slightly exaggerated in FIG. 3, with the width of each cap 22 generally equal to or slightly less than the corresponding width of sleeve 16. In addition, such cross-sectional length of sleeve 16 may be slightly shorter than the interior cross-sectonal length of slot 20*b* by a distance $l_3+l_4$ shown slightly exaggerated in FIG. 3, and the width of sleeve 16 is preferably slightly less than the corresponding width of slot 20*b* in order to accommodate insertion of sleeve 16 with cap 22 mounted thereon. As preferably embodied, the sum of $l_3$ and $l_4$ as well as the difference between the width of slot 20*b* and that of the exterior of sleeve 16, at corresponding locations, are each slightly less than twice the thickness, t, of cap 22, in order that a sealing attachment may be formed by force fitting the end of sleeve 16 with cap 22 thereon into slot 20*b*.

Also as preferably embodied, each mounting bracket 20 includes a suitable base adapted for mounting onto the desired mounting structure. To this end, the base of mounting brackets 20 are adapted to receive interchangeable adaptor plates 24 which are adapted for releasable engagement with mounting brackets 20, such as by forming reciprocally co-acting slots (shown here at 20*a* on bracket 20) and protrusions (shown here at 24*a* on adaptor plate 24) having appropriate angular orientations thereon for allowing only slidable interconnection and preventing disassembly by other than such relative slidable movement. Advantageously, mounting plates 24 are formed with lip members 24*b* adapted to prevent slidable insertion of plate 24 onto bracket 20 beyond a predetermined point.

Once mounting brackets 20 have been installed onto sleeve 16, double-backed adhesive members 26 may be attached to the bottom (i.e., the mounting surface) of mounting brackets 20. As illustrated herein, mounting brackets 20 are formed with curved bottom surfaces which are suitable for attaching device 10 to a curved mounting structure, such as a round-topped mailbox. However, if the mounting structure has an essentially flat surface such as flat-topped mailbox 28, an adaptor plate 24 with a correspondingly rounded upper surface but a flat bottom (or mounting surface), may be slidably attached to bracket 20, as more fully described hereinbefore, with adhesive members 26 attached to such flat bottom surface to provide secure attachment to the flat surface of the mounting structure.

Advantageously, when plates 24 are attached to brackets 20, lip members **24*b* are positioned symmetrically (i.e. both on the inside of brackets 20 or both on the outside of brackets 20) to substantially prevent the display device from slidable movement relative to the mounting structure. As preferably embodied, both lips 24*b* face outwardly to cover the slot/protrusion (20*a*/24*a***) arrangement for a more attractive appearance.

It will be understood that when brackets 20 are mounted to a round-top mailbox so that adaptor plates 24 are not needed, slots **20*a*** on the mounting bracket can accommodate certain structures formed on the mailbox top such as the base of the clamp for holding the mailbox door closed.

Accordingly, the present invention in its broader aspects is not limited to the specific embodiments herein shown and described. Rather, variations may be made therefrom within the scope of the accompanying claims, without departing from the principles of the invention and without sacrificing its chief advantages.

What is claimed is:

1. An assemblable display apparatus for mounting to mailboxes and the like, which comprises:

a generally elongate base plate adapted to support the characters of a desired message;

a substantially transparent, generally tubular, sleeve member having two open ends and being adapted to enclose said base plate, said sleeve member extending at least about as long as said base plate; and a pair of mounting assemblies adapted to be attached to each end of said sleeve member to provide both an essentially moisture-proof seal at the ends of said sleeve member and a mounting surface corresponding generally to the surface of the mounting structure to which said display apparatus is to be mounted, such that, when said display apparatus is assembled, with said sleeve member enclosing said base plate and said mounting assemblies attached to the ends of said sleeve member, the display apparatus can be mounted to the desired mounting surface by said mounting assemblies and any message formed on said base plate will be viewable through the sleeve element yet substantially protected from moisture by said mounting assemblies

2. A display apparatus according to claim 1 wherein each of said mounting assemblies comprises:

a generally flexible end cap proportioned to cover an end of said sleeve member in a generally sealing manner;

a mounting bracket proportioned to cover and end of said sleeve member with a said end cap therebetween, each said mounting bracket adapted to provide a mounting surface corresponding to the surface of the mounting structure; and attachment means for securing the mounting surface of each said mounting bracket to the mounting structure surface.

3. A display apparatus according to claim 2 wherein said base plate and said mounting brackets are made of a moldable plastic material, said sleeve member is made of substantially transparent moldable plastic material and said end caps are made of plastisol.

4. A display apparatus according to claim 1 wherein said sleeve member is made of an essentially transparent moldable plastic material.

5. An assemblable display apparatus for mounting to mailboxes and the like, which comprises:

a generally elongate base plate adapted to support the characters of a desired message;

a substantially transparent, generally tubular, sleeve member having two open ends and being adapted to enclose said base plate, said sleeve member extending at least about as long as said base plate; and a mounting assembly adapted for attachment to each end of said sleeve member, each said mounting assembly including:

a generally flexible end cap proportioned to cover and end of said sleeve member in a generally sealing manner, a mounting bracket proportioned to cover an end of said sleeve member with a said end cap therebetween, an adaptor plate having a first surface adapted for releasable attachment to a said mounting bracket and a second surface adapted for attachment directly to the mounting structure to which said display apparatus is to be mounted, and attachment means for securing the mounting surface of each said adaptor plate to the mounting structure, such that, when said display apparatus is assembled, with said sleeve member enclosing said base plate and a said mounting assembly attached to each end of said sleeve member for providing a substantially moisture-proof seal thereat, any message on said base plate can be viewed through said sleeve member and said apparatus can be mounted to the desired mounting structure by selecting adaptor plates which have second surfaces conforming to the surface of said mounting structure.

6. A display device according to claim 5 wherein said mounting bracket and the first surface of each said adaptor plate are formed with reciprocal slot and protrusion means for permitting slidable engagement of said mounting bracket and said mounting plate, such that said mounting bracket and said adaptor plate may be coupled together by slidable engagement between said reciprocal slot and protrusion means.

7. A display apparatus according to claim 6 wherein each of said adaptor plates includes a lip member proportioned to prevent relative slidable movement between said mounting bracket and said adaptor plate beyond a predetermined point.

8. A display apparatus according to claim 7 wherein said attachment means comprises a plurality of double-adhesive tab members.

9. A display apparatus according to claim 8 wherein the message characters are formed on generally thing pliable plastic members having an adhesive backing.

10. A display apparatus according to claim 5 wherein said sleeve member is made of a substantially transparent moldable plastic material.

11. A display device according to claim 10 wherein each said mounting bracket and each adaptor plate are made of a moldable plastic material.

12. An assemblable display apparatus for mounting to mailboxes and the like, which comprises:

a generally elongate base plate adapted to support the characters of a desired message;

a substantially transparent, generally tubular, sleeve member having at least one open end and being adapted to enclose said base plate, said sleeve member extending at least about as long as said base plate; and a mounting assembly adapted to be attached to each open end of said sleeve member to provide both an essentially moisture-proof seal at the open end of said sleeve member and a mounting surface corresponding generally to the surface of the mounting structure to which said display apparatus is to be mounted, such that, when said display apparatus is assembled, with said sleeve member enclosing said base plate and a said mounting assembly attached to each open end of said sleeve member, the display apparatus can be mounted to the desired mounting surface by each said mounting assembly and any message formed on said base plate will be viewable through the sleeve element yet substantially protected from moisutre by each said mounting assembly.

13. A display apparatus according to claim 12, wherein each said mounting assembly comprises:

a generally flexible end cap proportioned to cover an open end of said sleeve member in a generally sealing manner;

a mounting bracket proportioned to cover an open end of said sleeve member with a said end cap therebetween, said mounting bracket adapted to provide a mounting surface corresponding to the surface of the mounting structure; and attachment means for securing the mounting surface of said mounting bracket to the mounting structure surface.

14. A display apparatus according to claim 13, wherein each mounting assembly further includes an adaptor plate having a first surface adapted for releasable attachment to a said mounting bracket and a second surface adapted for attachment directly to the mounting structure by said attachment means, such that each said adaptor plate is removably attachable to said mounting bracket to permit interchanging the mounting surface of each said mounting assembly so as to conform generally to the mounting surface of the mounting structure.

* * * * *